United States Patent [19]

Kaiser

[11] Patent Number: 4,575,657

[45] Date of Patent: Mar. 11, 1986

[54] PHOTOMULTIPLIER TUBE HAVING AN IMPROVED CENTERING AND CATHODE CONTACTING STRUCTURE

[75] Inventor: Donald B. Kaiser, Lancaster, Pa.

[73] Assignee: RCA Corporation, Princeton, N.J.

[21] Appl. No.: 611,958

[22] Filed: May 18, 1984

[51] Int. Cl.[4] ..... H01J 40/04; H01J 43/26; H01J 19/42

[52] U.S. Cl. ..... 313/533; 313/261; 313/536

[58] Field of Search ..... 313/536, 533, 532, 535, 313/261

[56] References Cited

U.S. PATENT DOCUMENTS

| | | | |
|---|---|---|---|
| Re. 30,249 | 4/1980 | Faulkner | 313/104 |
| 2,121,636 | 6/1938 | Koller . | |
| 2,137,571 | 11/1938 | Glauber | 313/261 X |
| 2,160,593 | 5/1939 | Kling | 250/165 |
| 2,829,293 | 4/1958 | Widmaier . | |
| 2,868,994 | 1/1959 | Anderson | 313/536 X |
| 2,880,344 | 3/1959 | Stoudenheimer . | |
| 4,370,585 | 1/1983 | Butterwick . | |
| 4,426,596 | 1/1984 | Butterwick | 313/534 |
| 4,446,401 | 5/1984 | Faulkner et al. | 313/533 |
| 4,447,758 | 5/1984 | Faulkner et al. | 313/532 |

OTHER PUBLICATIONS

U.S. Patent Application, by A. F. McDonie et al., entitled, "Shield Cup to Cage Assembly Connecting Tab Member", filed concurrently herewith (RCA 81,007), Ser. No. 611,873.

U.S. Patent Application, by A. F. McDonie et al., entitled, "Photomultiplier Tube Having an Electron Multiplier Cage Assembly with Uniform Transverse Spacing", filed concurrently herewith (RCA 80,965), Ser. No. 611,753.

U.S. Patent Application, by D. B. Kaiser, entitled, "Electrode Structure for an Electron Multiplier Cage Assembly", filed concurrently herewith (RCA 80,966), Ser. No. 611,754.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

A photomultiplier tube comprises an evacuated envelope including a faceplate and a sidewall. A conductive coating is disposed annularly around an interior portion of the sidewall adjacent to the faceplate and on a longitudinally extending portion of the sidewall as a strip. A photoemissive cathode is disposed on an interior surface of the faceplate and on the conductive coating adjacent thereto. A shield cup is spaced from the cathode and centered within the envelope by a plurality of bulb spacers. An electron multiplier cage assembly abuts the shield cup and is attached thereto. A cathode contact assembly is in contact with the strip on the sidewall. A plurality of locating slots are formed in the base of the shield cup to orient the bulb spacers in contact with the sidewall of the envelope and spaced from the longitudinally extending strip portion of the conductive coating thereon. The bulb spacers include stop shoulders which retain the bulb spacers within the locating slots. The cathode contact assembly includes a cathode contact support member and a resilient cathode contact member. The cathode contact support member includes an electrical contact tab struck from the body thereof and a cathode support tab which includes an extruded area to circumferentially locate the resilient cathode contact member between two consecutively spaced bulb spacers and to align the resilient cathode contact member with the longitudinally extending strip portion of the conductive coating on the sidewall of the envelope.

6 Claims, 8 Drawing Figures

PHOTOMULTIPLIER TUBE HAVING AN IMPROVED CENTERING AND CATHODE CONTACTING STRUCTURE

BACKGROUND OF THE INVENTION

The present invention relates to photomultiplier tubes and, more particularly, to a photomultiplier tube having a conductive strip disposed on the envelope sidewall which is connected to a photoemissive cathode. Electrical connection to the conductive strip is provided by a resilient cathode contact member which is attached to a cathode contact support member. The cathode contact support member includes alignment means which aligns the resilient cathode contact member with the conductive strip. The tube includes a shield cup which has attached thereto an electron multiplier cage assembly. The shield cup is centered by means of a plurality of bulb contacts which are disposed within the bulb locating means formed in the shield cup. The bulb locating means are oriented such that the bulb contacts can contact the sidewall of the tube envelope without contacting the conductive strip connected to the photocathode.

In U.S. Pat. No. 4,370,585, issued to G. N. Butterwick on Jan. 25, 1983, shows a photomultiplier tube having an evacuated glass bulb with a shield affixed to one end of a dynode assembly and having a plurality of prong-like bulb contact members attached to the outer surface of the shield. The first dynode of the dynode assembly is affixed to the shield. An aluminum coating is disposed on the sidewall of the bulb, and a portion of the coating extends longitudinally along the sidewall and is contacted by a tab-type cathode contact member which comprises one element of an evaporator structure affixed to one side of the dynode assembly. A photoemissive cathode is formed on an interior surface of the bulb and on a portion of the aluminum coating. In the structure described in the foregoing Butterwick patent, the shield operates at a potential different from that applied to the cathode; thus, it is necessary that the bulb contact members, which center the dynode assembly, do not contact the aluminum coating on the envelope. If the bulb contact members are improperly positioned on the shield so that they contact the aluminum coating, an electrical short results between the cathode and the first dynode of the dynode assembly which is attached to the shield.

U.S. Pat. No. 4,426, 596, issued to G. N. Butterwick on Jan. 17, 1984, discloses a photomultiplier tube comprising a glass bulb having a plurality of circumferentially disposed strip-like bulb spacers attached to the outer surface of the shield cup. The shield cup supports a dynode cage assembly having a first dynode which is electrically connected to the shield cup. An aluminum coating is disposed around the faceplate of the glass bulb and in a longitudinally extending strip along a portion of the sidewall of the bulb. A photoemissive cathode is formed on the interior surface of the bulb and on a portion of the aluminum coating. A tab-like cathode contact is attached to a stem lead to apply cathode potential to the aluminum strip. The bulb spacers must be attached to the outer surface of the shield cup in such a manner that when inserted into the glass bulb, the bulb spacers do not contact the aluminum strip, or the shield cup and the first dynode will be shorted to the cathode rendering the tube inoperable.

The requirement that the bulb spacers do not contact the aluminum strip on the bulb sidewall requires careful fabrication and inspection of the tube before sealing to prevent loss of tubes due to electrical shorts. In order to improve efficiency and reliability of the tube, it is desirable that the tube structure provide means for accurately positioning the bulb spacers relative to the aluminum strip to prevent contact therebetween. It also is imperative that the cathode contact is accurately located with respect to the aluminum strip on the sidewall of the bulb to ensure that a potential can be applied to the strip and, thus, to the cathode.

SUMMARY OF THE INVENTION

A photomultiplier tube comprises an evacuated envelope including a faceplate and a sidewall. A conductive coating is disposed annularly around an interior portion of the sidewall adjacent to the faceplate and on a longitudinally extending portion of the sidewall as a strip. A photoemissive cathode is disposed on an interior surface of the faceplate and on the conductive coating adjacent thereto. A shield cup is spaced from the cathode and centered within the envelope by bulb contacts. An electron multiplier cage assembly abuts the shield cup and is attached thereto. A cathode contact assembly is in contact with the strip on the sidewall. The shield cup has formed therein bulb contact locating means which are oriented to position the bulb contacts in contact with the sidewall of the envelope and spaced from the longitudinally extending strip portion of the conductive coating. The bulb contacts each include stop means which retain the bulb contacts within the bulb contact locating means. The cathode contact assembly includes a cathode contact support member and a resilient cathode contact member. The cathode contact support member includes electrical contact means and a cathode support tab which has alignment means formed therein to circumferentially locate the resilient cathode contact member between two consecutively spaced bulb contacts and to align the resilient cathode contact member with the longitudinally extending strip portion of the conductive coating on the sidewall of the envelope.

DETAILED DESCRIPTION OF THE PREFERRED EMBODIMENT

Figure 1:
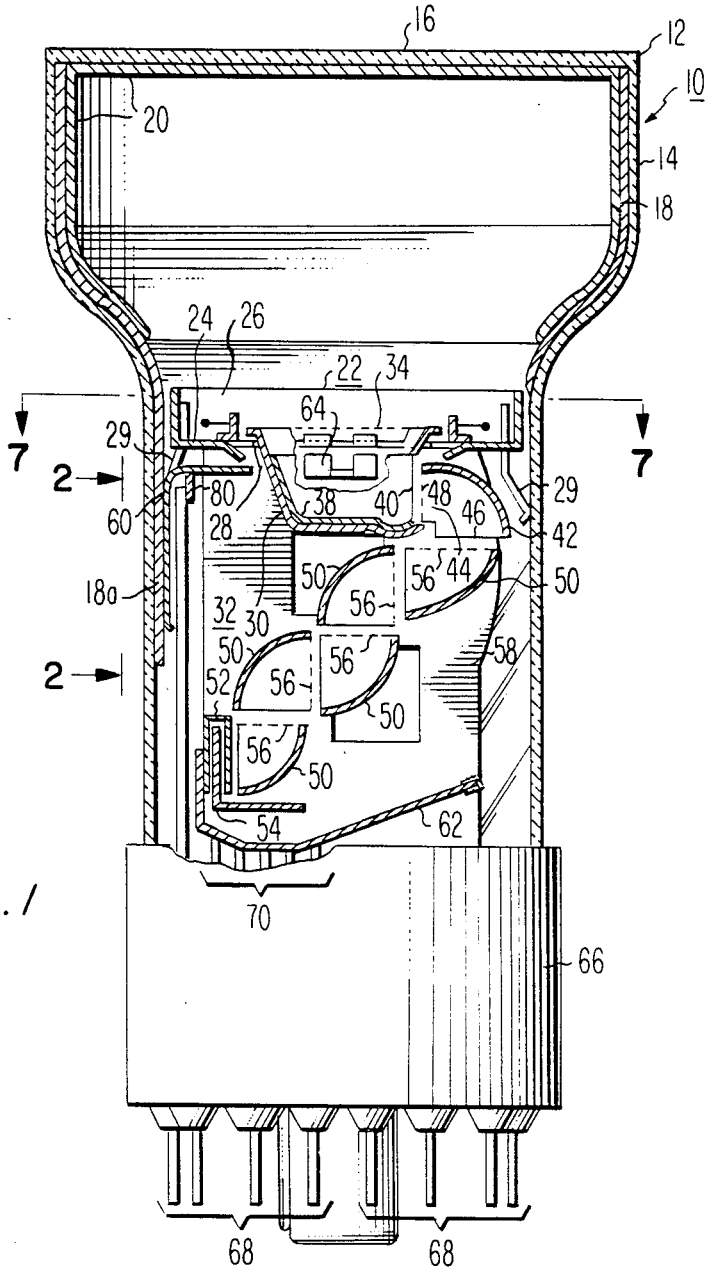
FIG. 1 is a partially broken away sectional view of a photomultiplier tube embodying the present invention.

A photomultiplier tube 10, shown in FIG. 1, comprises an evacuated envelope 12 having a sidewall 14. The envelope 12 is closed at one end by a transparent faceplate 16 and at the other end by a stem portion (not shown). A conductive layer 18 is vapor deposited annularly around an interior portion of the sidewall 14 adjacent to the faceplate 16 and on a longitudinally extending portion of the sidewall as a strip 18*a*. A photoemissive cathode 20 is formed on an interior surface of the faceplate 16 and also along a portion of the conductive layer 18 on the sidewall 14. The photoemissive cathode 20 may comprise any of the alkali-antimonide materials known in the art and is preferably a potassium-cesium antimonide structure. The photoemissive cathode 20 emits photoelectrons in response to radiation incident thereon.

A shield cup 22 is provided in spaced relation to the photoemissive cathode 20. The shield cup 22 is a cup-shaped field forming electrode having a substantially flat base portion 24 and an annular wall portion 26 disposed perpendicular to the base portion 24. In the present structure, the shield cup 22 is electrically isolated from the cathode 20 and operates at a potential different therefrom. A centrally disposed substantially rectangular aperture 28 extends through the base portion 24 of the shield cup 22. The shield cup 22 is centered within the envelope 12 by a plurality of novel bulb contacts or spacers 29. A primary dynode 30 is disposed within the aperture 28 and is spaced therefrom. The primary dynode 30 has a cross-sectional contour substantially identical to that described in U.S. Pat. No. Re. 30,249, issued to R. D. Faulkner on Apr. 1, 1980, and comprises the first electrode of an electron multiplier cage assembly 32. A substantially flat primary field mesh member 34 is affixed to an input aperture 36 of the primary dynode 30. The primary dynode 30 preferably comprises a nickel substrate with an alkali-antimonide secondary emission coating 38 formed thereon. Alternatively, the primary dynode may be formed of a beryllium-copper material having a beryllium-oxide secondary emissive surface. The primary dynode 30 has an output aperture 40.

The electron multiplier cage assembly 32 further includes a box-like secondary dynode 42 which acts as a receiving member for secondary electrons emitted from the secondary emission coating 38 of the primary dynode 30. The dynode 42 has an input end 44 and an output end 46. A secondary field mesh member 48 extends across the input end of the secondary dynode 42. A plurality of additional substantially-identical box-like secondary dynodes 50 are disposed between the secondary dynode 42 and an ultimate secondary dynode 52. The ultimate secondary dynode 52 encloses an anode 54. Each of the secondary dynodes 42, 50 and 52 is preferably formed of nickel and has an alkali-antimonide coating (not shown) formed on the inside surface thereof so that the dynode can propagate electron emission from the cathode 20 to the anode 54. Each of the secondary dynodes 50 includes a field mesh 56 disposed across the input end thereof. The primary dynode 30, the secondary dynodes 42, 50, 52 and the anode 54 are disposed between a pair of substantially parallel, spaced apart insulating support plates 58 (only one of which is shown in FIG. 1). A novel cathode contact assembly 60 extends transversely between the support plates 58 and is electrically connected to the cathode 20 through the conductive strip 18a on the sidewall 14. A light shield 62 closes the lower end of the cage assembly 32. The cage assembly 32 is attached to the shield cup 22 by means of a pair of connecting tab members 64 (only one of which is shown in FIG. 1). The connecting tab members are described in a copending U.S. patent application Ser. No. 611,873, filed concurrently herewith, assigned to the assignee of the present invention, entitled, "SHIELD CUP TO CAGE ASSEMBLY CONNECTING TAB MEMBER", by A. F. McDonie et al., which is incorporated by reference herein for the purpose of disclosure. A base 66, having a plurality of electrical contact pins 68 therein, is attached to the stem end of the envelope 12. A plurality of electrical leads 70, only some of which are shown, are connected between the photoemissive cathode 20, the shield cup 22, the dynodes 30, 42, 50, 52, the anode 54 and the pins 68 in the base 66.

Figure 2:
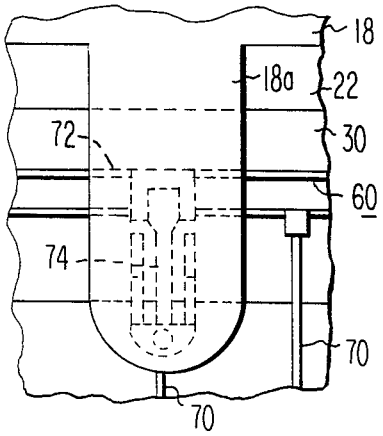
FIG. 2 is a fragmentary view of the tube taken along line 2—2 of FIG. 1.
Figure 3:
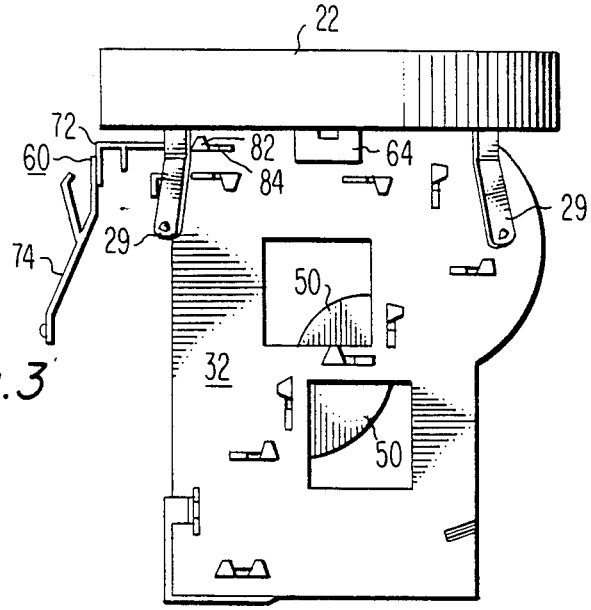
FIG. 3 is a front view of an electron multiplier cage assembly and shield cup.
Figure 4:
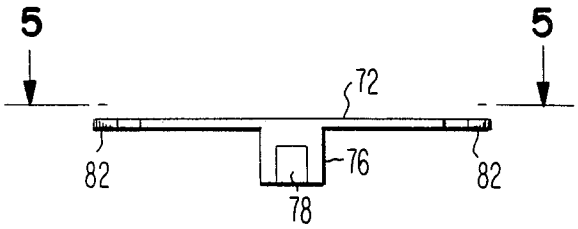
FIG. 4 is a plan view of a cathode contact support member.
Figure 5:
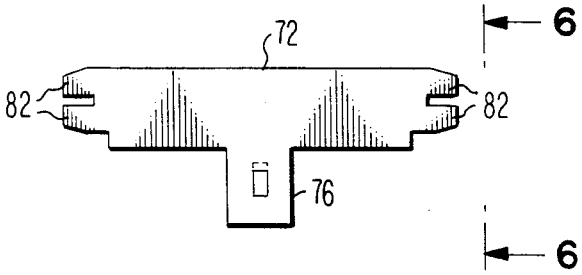
FIG. 5 is a top view taken along line 5—5 of FIG. 4.
Figure 6:
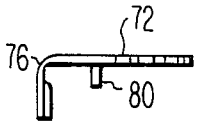
FIG. 6 is a side view taken along line 6—6 of FIG. 5.

As shown in FIGS. 2 and 3, the novel cathode contact assembly 60 includes a cathode contact support member 72 and a resilient cathode contact member 74 which is affixed thereto, for example by welding. Details of the cathode contact support member 72 are shown in FIGURES 4, 5 and 6. The cathode contact support member 72 includes an L-shaped cathode support tab 76 which extends from the body of the member 72. The surface of the tab 76 includes an extruded area 78, which is extruded to a depth of about 0.2 to 0.3 mm (0.008 to 0.012 inches), approximately equal to the thickness of the material which is used to form the member 72. The extruded area 78 provides alignment means for the resilient cathode contact member 74, which is nested in the extruded area 78 and welded therein to align with and contact the longitudinally extending strip portion 18*a* of the conductive coating 18, which is electrically connected to the photoemissive cathode 20. To facilitate electrical connection to the pins 68 in the base 66, an electrical contact tab 80 is struck from the body of the cathode support tab 76. One of the electrical leads 70 is welded between the tab 80 and one of the pins 68 in order to apply a potential to the cathode 20. The cathode contact support member 72 includes oppositely disposed attachment tabs 82, extending from the sides thereof, which provide means for attaching the cathode contact assembly 60 between the insulating support plates 58. As shown in FIG. 3, the attachment tabs 82 are disposed within a support slot 84.

Figure 8:
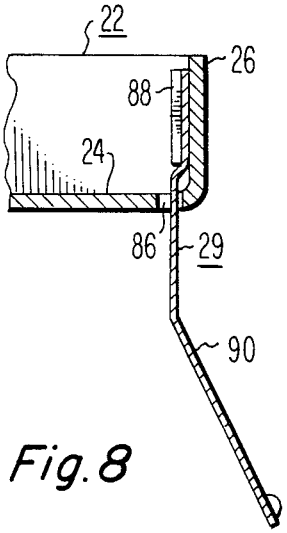
FIG. 8 is a longitudinal view of a shield cup and bulb spacer taken along line 8—8 of FIG. 7.
Figure 7:
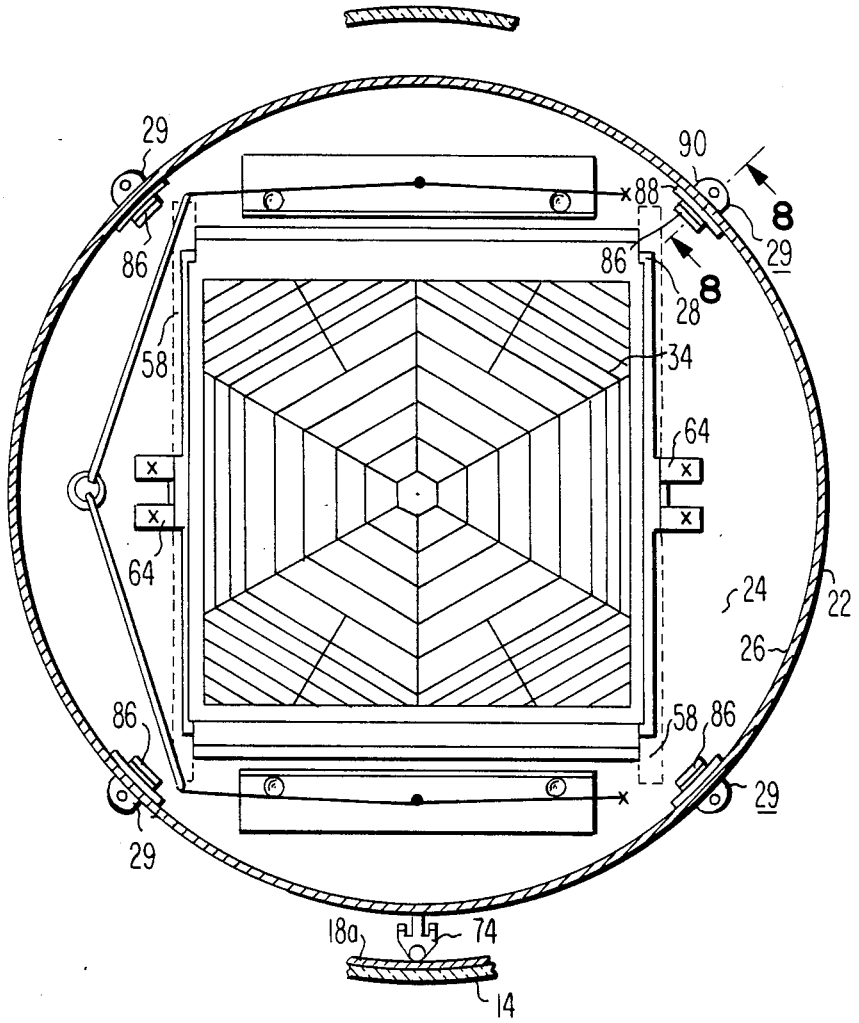
FIG. 7 is a sectional view of the tube taken along line 7—7 of FIG. 1.

FIGS. 3, 7 and 8 show the novel bulb spacers 29 which comprise the bulb contact means for centering the shield cup 22 and the attached cage assembly 32 within the envelope 12. As shown in FIG. 7, the shield cup 22 includes four locating slots 86 formed in the base portion 24 thereof adjacent to the wall portion 26. The locating slots 86 are oriented to be aligned radially along the diagonals connecting the oppositely facing corners of the rectangular aperture 28 formed in the shield cup 22. In the preferred embodiment, only four locating slots 86 are disposed at 90 degree intervals circumferentially around the shield cup 22 to provide bulb contact locating means for the bulb spacers 29 disposed therein. Each of the locating slots 86 has a dimension of about 3.18±0.05 mm (0.125±0.002 inches) long and 1.02±0.13 mm (0.040±0.005 inches) wide. Each of the bulb spacers 29 comprise an arcuately shaped stop shoulder portion 88, which conforms to the annular wall portion 26 of the shield cup 22 to facilitate attachment thereto, and an offset bulb contact portion 90. The stop shoulder portion 88 has a chordal length of 5.08±0.25 mm (0.200±0.010 inches) which is wider than the width (transverse dimension) of the locating slot 86 so that the bulb spacers 29 are retained within the locating slots 86. The stop shoulder portion 88 is welded to the wall portion 26 of the shield cup 22. The thickness of the bulb contact portion 90 of the bulb spacer 29 is preferably about 0.25 mm (0.010 inches), and the transverse dimension of the bulb contact portion 90 is about 3.05±0.05 mm (0.120±0.002 inches) which is substantially less than the width (transverse dimension) of the locating slot 86 so that the bulb contact portion 90 of the bulb spacer 29 extends freely through the locating slot 86 and can flex radially without contacting the base portion 24 of the shield cup 22. To facilitate contact with the envelope sidewall 14, the lower part of the bulb contact portion 90 is angled outwardly toward the sidewall about 20 degrees. The orientation of the locating slots 86 position the bulb spacers 29 such that the resilient cathode contact member 74 is circumferentially located between two consecutive bulb spacers 29 and is aligned with the conductive strip 18a on the sidewall 14. This orientation ensures that the bulb spacers 29 cannot contact the conductive strip 18*a*. Thus, the present structure eliminates the possibility of inadvertently shorting the shield cup 22 to the cathode 20.

What is claimed is:

1. In a photomultiplier tube comprising an evacuated envelope including a faceplate and a sidewall, a conductive coating disposed annularly around an interior portion of said sidewall adjacent to said faceplate and on a longitudinally extending portion of said sidewall as a strip, a photoemissive cathode disposed on an interior surface of said faceplate and on said conductive coating adjacent thereto, a shield cup spaced from said cathode and centered within said envelope by a plurality of bulb contacts, an electron multiplier cage assembly abutting said shield cup and attached thereto, and a cathode contact assembly in contact with said strip on said sidewall, the improvement comprising said shield cup including bulb contact locating means formed therein, said locating means being oriented to position said bulb contacts in contact with said sidewall of said envelope and spaced from said longitudinally extending strip portion of said conductive coating, said bulb contacts each including a stop means that retains said bulb contact within said bulb contact locating means, and said cathode contact assembly including a cathode contact support member and a resilient cathode contact member, said cathode contact support member including a cathode support tab having alignment means therein to circumferentially locate said resilient cathode contact member between two consecutively spaced bulb contacts and to align said resilient cathode contact member with said longitudinally extending strip portion of said conductive coating on said sidewall of said envelope.

2. The tube as in claim 1, wherein said bulb contact locating means comprises a plurality of locating slots formed in said shield cup, said slots being circumferentially disposed around the periphery of said shield cup.

3. The tube as in claim 2, wherein each of said bulb contacts comprises a stop shoulder portion and a bulb contact portion, each of said bulb contacts being disposed in a different one of said locating slots and retained therein by said stop shoulder portion of said bulb contact which is wider than said locating slots, said stop shoulder portion being attached to said shield cup.

4. The tube as in claim 1, wherein said alignment means of said cathode support tab comprises an extruded area conforming to a portion of said resilient cathode contact member whereby said resilient cathode contact member may be accommodated within said extruded area.

5. The tube as in claim 1, wherein said cathode contact support member includes an electrical contact tab struck from the body of said cathode contact support member.

6. In a photomultiplier tube comprising an evacuated envelope including a faceplate and a sidewall, a conductive coating disposed annularly around an interior portion of said sidewall adjacent to said faceplate and on a longitudinally extending portion of said sidewall as a strip, a photoemissive cathode disposed on an interior surface of said faceplate and on said conductive coating adjacent thereto, a shield cup spaced from said cathode and centered within said envelope by a plurality of bulb spacers, said shield cup having a substantially flat base portion and an annular wall portion disposed perpendicular to said base portion, said base portion having a substantially rectangular aperture formed therein, a base attached to said envelope and having a plurality of electrical contact pins therein, and an electron multiplier cage assembly abutting said shield cup, said cage assembly including a pair of transversely spaced insulating support plates having a plurality of support slots formed therethrough, a cathode contact assembly disposed between said support plates and attached thereto in contact with said strip on said sidewall, a primary dynode, a plurality of secondary dynodes and an anode disposed between said support plates and attached thereto, said primary dynode being disposed within said aperture in said shield cup, and a plurality of electrical leads connecting said photocathode, said shield cup, said dynodes and said anode to said pins in said base, wherein the improvement comprising said shield cup having a plurality of locating slots formed in said base portion thereof adjacent to said wall portion, each of said bulb spacers being disposed within a different one of said locating slots, said slots being oriented to position said bulb spacers in contact with said sidewall of said envelope and spaced from said longitudinally extending strip portion of said conductive coating, said slots having sufficient breadth so as to permit bulb spacers to flex radially without contacting said base portion of said shield cup, each of said bulb spacers having a stop shoulder portion and a bulb contact portion, which is narrower than said stop shoulder portion, said stop shoulder portion being arcuately shaped to conform to said annular wall portion of said shield cup to facilitate attachment thereto, said stop shoulder portion of said bulb spacers being wider than said locating slots to retain said bulb spacers within said slots, said bulb contact portion of said bulb spacers being slightly offset relative to said stop shoulder portion whereby said bulb contact portion of said bulb spacers may extend freely through said locating slots, and said cathode contact assembly including a cathode contact support member disposed within support slots in said support plates and a resilient cathode contact member, said cathode contact support member including an L-shaped cathode support tab having an extruded area therein to circumferentially locate said resilient cathode contact member between two consecutively spaced bulb spacers and to align said resilient cathode contact member with said longitudinally extending portion of said conductive coating on said sidewall of said envelope, and an electrical contact tab struck from the body of said cathode support tab.

* * * * *